United States Patent [19]

Cahill

[11] 4,401,037

[45] Aug. 30, 1983

[54] SECURITY TRANSFER ARRANGEMENTS

[76] Inventor: Dermot J. Cahill, 137 Kimbolton Rd., Bedford MK41 8DT, England

[21] Appl. No.: 298,544

[22] Filed: Sep. 1, 1981

[30] Foreign Application Priority Data

Sep. 8, 1980 [GB] United Kingdom ..... 8028991

[51] Int. Cl.[3] ..... E05G 7/00; B65D 91/00; E06B 7/00; E05C 1/06

[52] U.S. Cl. ..... 109/10; 232/43.4; 49/68; 292/182

[58] Field of Search ..... 109/10–13, 109/16, 22, 7, 68; 49/68; 292/140, 169, 182; 232/43.4, 1 E

[56] References Cited

U.S. PATENT DOCUMENTS

| | | | |
|---|---|---|---|
| 1,008,125 | 11/1911 | Eichcikraut | 109/68 |
| 1,478,552 | 12/1923 | Chapman | 232/43.4 |
| 1,632,683 | 6/1927 | Tracy | 109/7 |
| 3,054,555 | 9/1962 | Saxon | 232/43.4 |
| 3,669,038 | 6/1972 | Watson | 109/12 |
| 4,011,686 | 3/1977 | Jett et al. | 49/68 |

FOREIGN PATENT DOCUMENTS

| | | |
|---|---|---|
| 1419382 | 12/1925 | United Kingdom . |
| 532536 | 1/1941 | United Kingdom . |

*Primary Examiner*—Robert Peshock
*Assistant Examiner*—John Weiss
*Attorney, Agent, or Firm*—Pollock, Vande Sande & Priddy

[57] ABSTRACT

A security transfer unit has a cashier's door and a customer's door for providing access to an intermediate transfer chamber from opposite sides of a security screen. Only one of the doors can be opened to give access to the chamber at a time, opening of the cashier's door being normally obstructed by a pivotted bar that is swung down across the door to engage a bracket. Swinging of the bar up to remove the obstruction turns a shaft to block, via a cam, withdrawal of catch-bolts which hold the customer's door closed. The cam in this condition also abuts a block mounted on the rear edge of the door such that if the customer's door is open as the bar is swung up it will be forced closed before the cashier's door can be opened.

16 Claims, 5 Drawing Figures

SECURITY TRANSFER ARRANGEMENTS

This invention relates to security transfer arrangements of the kind in which access to a chamber for entering items into, and removing them from, the chamber, is made via two mutually-spaced doors, and in which provision is made to enable only one of the doors to be opened to give access to the chamber, at a time.

Security transfer arrangements of this kind are described in U.K. Patent Specification Nos. 532,536 and 1,419,382 and find application in particular, though not exclusively, in banks and other institutions where cash and other valuables are to be transferred through a security barrier between regions of open and restricted access. In a bank, for example, the transfer arrangements may be installed in the counter or security screen that separates the cashier from customers, with one door on the inside of the counter or screen to be accessible to the cashier, and the other door on the outside to be accessible from the public area of the bank. Cash or other items can be transferred to a cashier from this public area simply by opening the outside door and entering such items into the chamber between the doors, and then closing the outside door so as to enable the cashier to open the inside door and remove the deposited items from the chamber. Transfer from the cashier to a customer or other person in the public area can be made in the opposite direction by reversing the procedure, there being provision for interlocking of the doors so as to ensure that only one door can be open at any one time to preserve security. Circumstances may arise, however, where security is put in jeopardy in spite of such interlocking, and it is one of the objects of the present invention to provide a security transfer arrangement of the above-specified kind that may be used to avoid this.

According to the present invention, there is provided a security transfer arrangement of the above-specified kind, including means which is actuable in respect of one of the doors to free that door for opening and which upon such actuation is effective to close the other door if such is then open.

The security transfer arrangement according to the present invention is especially advantageous where said other door, more particularly the door on the outside of the security barrier, is left open inadvertently or otherwise, after use. With known arrangements there is the danger in such circumstances that the interlocking mechanism will be operable to free the inside door to be opened while the outside door remains open, or alternatively and depending on the nature of that mechanism, blocks all further use of the arrangement until the outside door has been closed from the outside. The first of these two conditions is unacceptable as providing a clear breach of the security of the barrier, and the second leads to the security being compromised in another way. More particularly in the latter respect, there is the danger that the cashier or other person operating the security transfer arrangement on the inside of the barrier, will themselves be required, or will be induced, to pass through the security barrier temporarily for the purpose of closing the outside door so as to enable normal operation of the arrangement to be resumed. Passage of a person through the security barrier for such a purpose is generally undesirable in that among other things, it can readily lead to laxity in security procedures. Where the security of cash or other valuables is involved moreover, it is especially undesirable in giving rise to a predictability of action by bank or other staff that is open to exploitation by persons of ill-intent.

The said means actuable to close the said other door in the security transfer arrangement of the present invention, may include a bar or other member that is displaceable between two positions in a first of which opening of said one door is precluded and in the second of which opening of said one door is freed. In these circumstances a mechanism may be provided to act upon the said other door to close it if it is open, and then to hold it closed, in response to displacement of the said member from its said first position towards its said second position.

Where a bar or other member as referred to in the preceding paragraph is utilized, this may advantageously be arranged to extend at least part way across the said one door, so as to block opening of that door, when in the said first position. In this way it is possible to avoid the necessity for any complicated interlocking mechanism between the two doors.

A security transfer arrangement in accordance with the present invention and in the form of a discrete unit as installed through a security barrier of a bank, will now be described, by way of example, with references to the accompanying drawings, in which.

Figure 1:
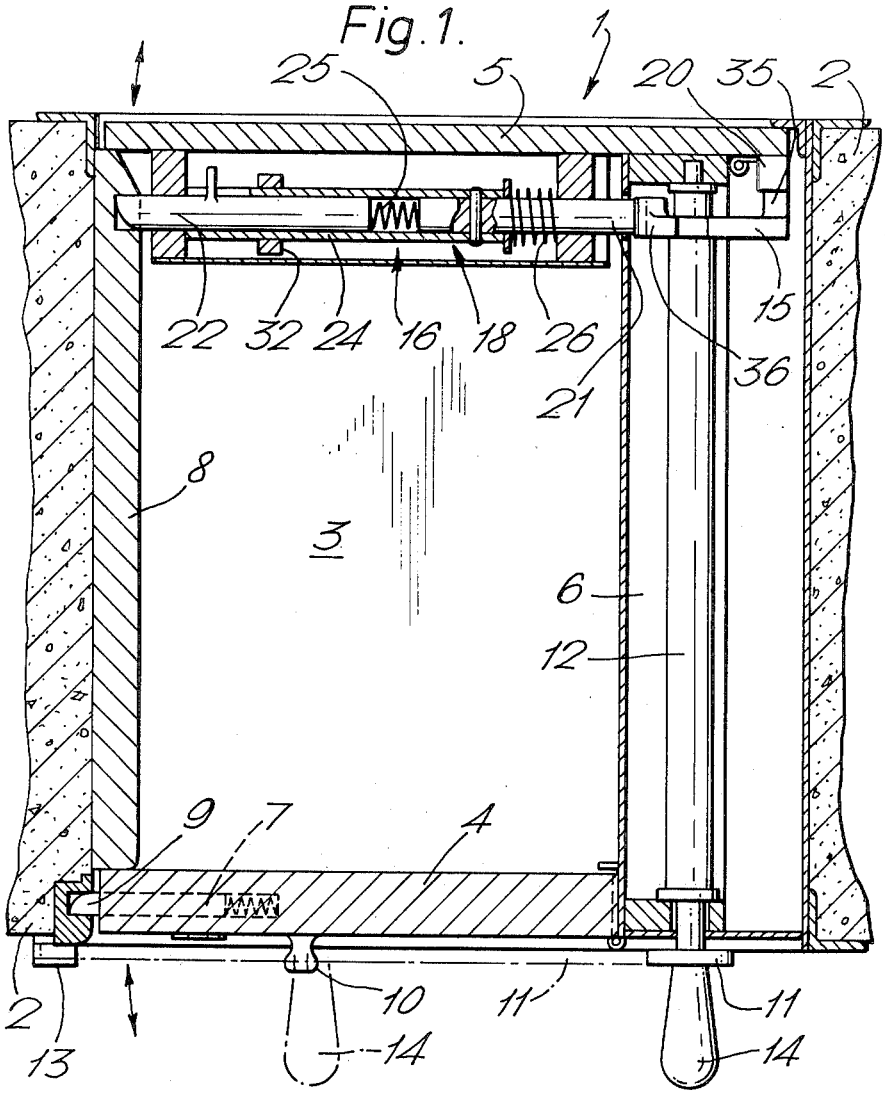
FIG. 1 is a sectional-plan view of the installation.

Referring to FIG. 1, a hollow, open-ended, rectangular box-structure 1 of the security transfer unit is mounted to extend through the wall 2 of the security barrier and provide an enclosed rectangular chamber 3 (having, for example, a height of some 67 cm, a width of some 34 cm and a depth of some 40 cm) within the wall 2. Access to the chamber 3 from opposite sides of the wall 2 is provided through two doors 4 and 5 of the unit which close the two ends of the structure 1, the door 4 (see also FIG. 2) enabling access to be gained from the cashier's side of the wall 2, and the door 5 (see also FIGS. 3 and 4) from the other, customer's side.

Figure 2:
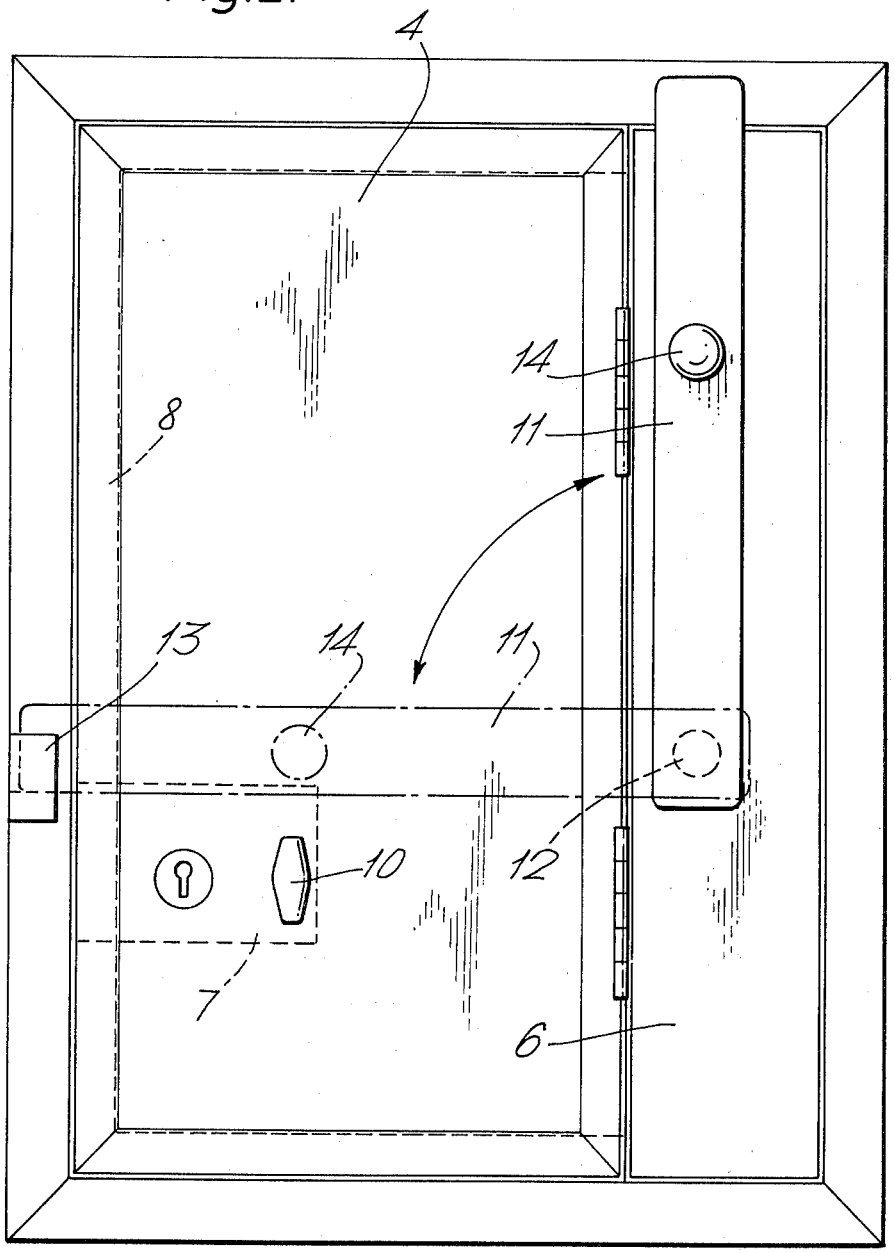
FIG. 2 is an end elevation of the security transfer unit showing the cashier's door of the unit inside the security barrier of the bank.

The cashier's door 4, which is hinged to a hollow side-wall 6 of the structure 1 to open outwardly therefrom, incorporates a latching and locking mechanism 7 for engaging with the opposite side-wall 8 of the structure 1. The mechanism 7 includes a bevelled spring-bolt 9 that enables the door 4 to be pushed closed and latched to the wall 8, and also has provision for locking the door 4 closed in this way by key operation. While the door 4 is unlocked, a knob 10 of the mechanism 7 can be turned by the cashier to withdraw the bolt 9 and allow for the door 4 to be opened. However, the door 4 can be opened only after a pivotted bar 11 that normally extends fully across the outermost face of the door 4 (as shown in broken line in FIGS. 1 and 2), has been swung up through an arc substantially coplanar with the door 4, into a vertical position as illustrated in FIG. 2.

The bar 11 is fixed to a shaft 12 that is rotatably mounted within the hollow side-wall 6, and in the horizontal position across the door 4 normally occupied, engages in a fixed bracket 13 and blocks entirely the path of outward, opening movement of the door 4. A handle 14 is provided on the bar 11 to facilitate the swinging of it upwardly to the vertical position in freeing the door 4 for opening, and subsequent swinging of it downwardly to the horizontal to block such opening once again.

Figure 3:
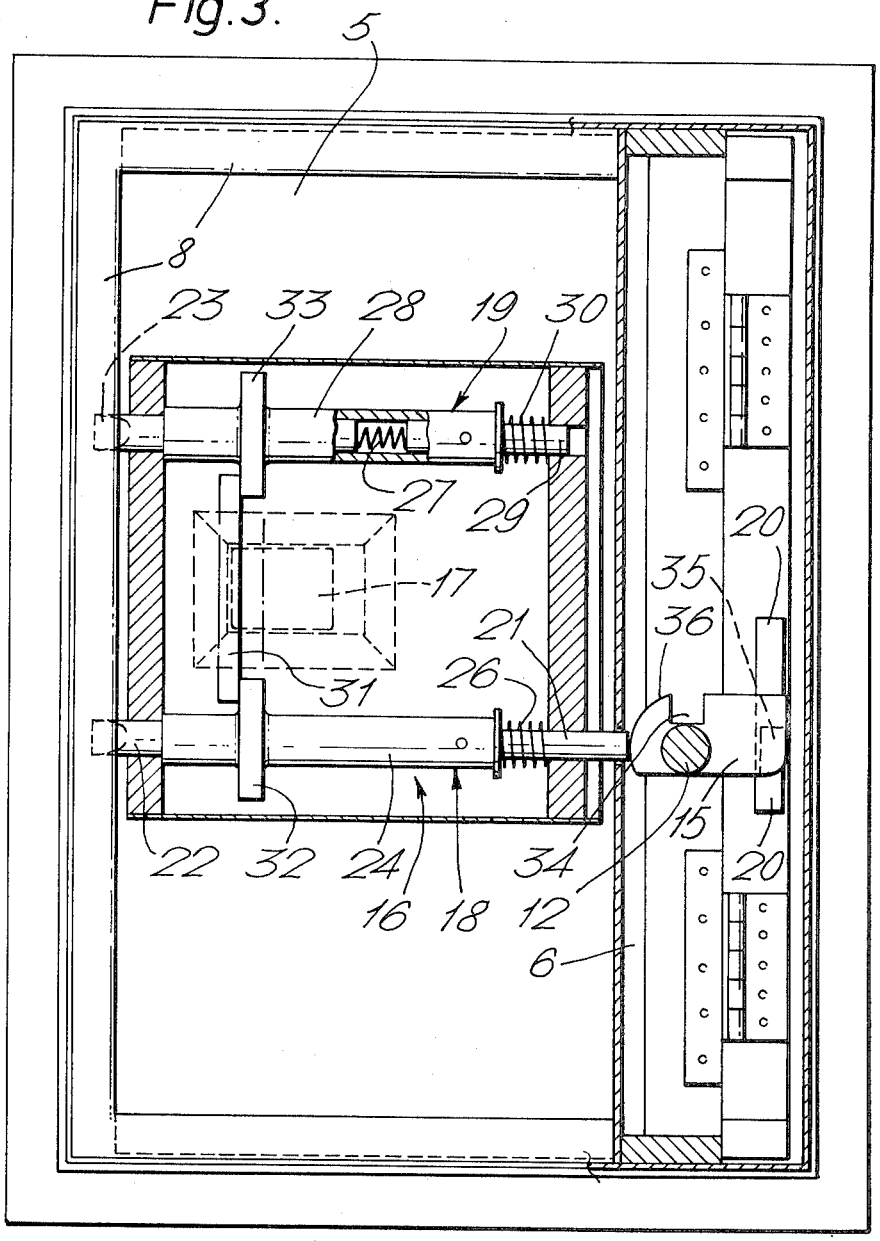
FIG. 3 is an end elevation, partly in section, viewed from the cashier's door within the security transfer unit, and showing the inside of the other, customer's door
Figure 4:
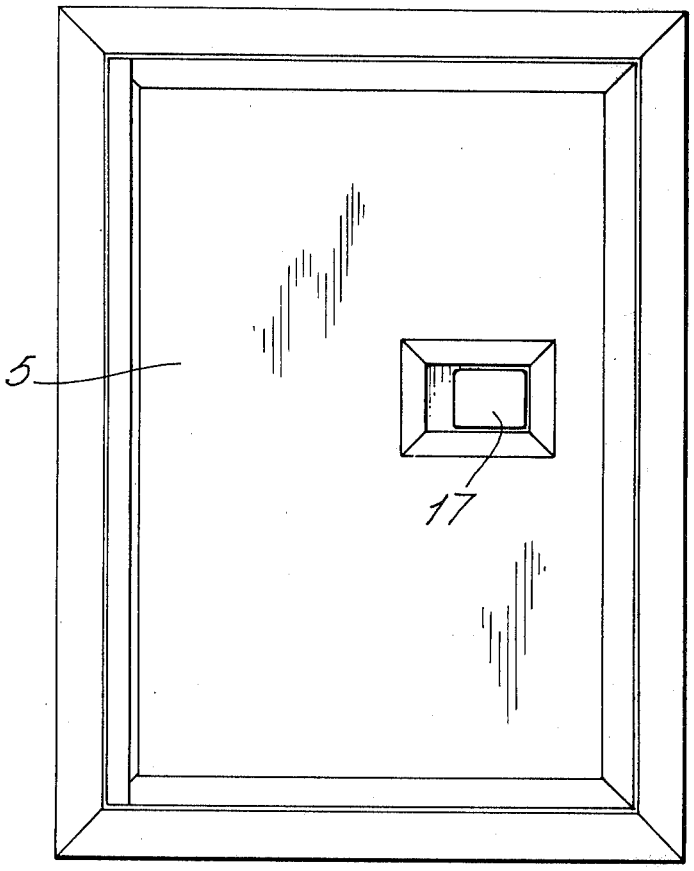
FIG. 4 shows (to a reduced scale) the customer's door from the outside.

Referring now also to FIG. 3, the shaft 12 carrying the bar 11 extends the length of the structure 1 within the wall 6 and carries a cam 15 adjacent the internal hinging of the customer's outwardly-opening door 5 to the wall 6. The cam 15 co-operates with boltwork 16 that is mounted on the door 5 internally of the structure 1, the cam 15 freeing the door 5 to be opened by operation of an external handle 17 (see FIG. 4 also) of the door 5, or locking it closed, according to whether the bar 11 is horizontal or vertical. More particularly, the boltwork 16 includes two horizontally-mounted spring-bolt assemblies 18 and 19. The bolt assemblies 18 and 19 can be withdrawn by operation of the handle 17 to free the customer's door 5 for opening, only when the bar 11 is horizontal and opening of the cashier's door 4 is thereby blocked. On the other hand, when the bar 11 is vertical so that the cashier's door 4 is free to be opened, the cam 15 is oriented to obstruct via a block 20 mounted on the rear of the door 5 and a rod 21 of the assembly 18, not only any opening of the customer's door 5, but even withdrawal of the bolt assemblies 18 and 19 that hold it closed.

The assemblies 18 and 19 include respective bevelled latchbolts 22 and 23 for engaging with the side-wall 8 of the structure 1 in holding the door 5 closed. The bolt 22 is free for limited sliding coaxially within a horizontal tube 24 of the assembly 18, which is pinned to the rod 21 to move axially with it. A spring 25 (FIG. 1) within the tube 24 urges the bolt 22 outwardly sideways of the door 5, and the tube 24 itself together with the rod 21, is urged in the same direction by a spring 26. The bolt 23 is similarly urged resiliently outwardly by a spring 27 from within a horizontal tube 28 of the assembly 19, which is pinned to a rod 29 (similar to the rod 21 but shorter in this case, and which together with the rod 29 is also urged in the same direction by a spring 30. A vertical bar 31, which as part of the boltwork 16 is coupled to the handle 17, engages with lugs 32 and 33 that are welded to the tubes 24 and 28 respectively, so that operation of the handle 17 acts to withdraw the bolt assemblies 18 and 19 against the actions of their respective springs 26 and 30. However withdrawal of the bolt assembly 18 is obstructed (as shown in FIG. 3) while the bar 11 is vertical, by abutment of the rod 21 with the cam 15. Such obstruction, acting via the lug 32 upon the bar 31 and thence via the lug 33 upon the tube 28, obstructs the withdrawal of the bolt assembly 19 too. Any attempt to operate the handle 17 to open the door 5 is accordingly ineffective, the bolts 22 and 23 thereby remaining engaged with the wall 8 to hold the door 5 locked closed while the bar 11 remains in the vertical position.

Swinging of the bar 11 to the horizontal position across the cashier's door 4, turns the cam 15 to break its obstruction to the rod 21. Indeed such turning brings a slot 34 of the cam 15 into alignment with the rod 21 to enable full travel of the rod 21 against the action of the spring 26. Obstruction to withdrawal of the bolt assembly 18, and with it of the bolt assembly 19, is accordingly removed so that operation of the handle 17 will now be effective to withdraw the bolts 22 and 23 to unlock the customer's door 5. While the handle 17 is operated in this way, the rod 21 enters the slot 34 of the cam 15 and so obstructs turning of the cam 15; this precludes any movement of the bar 11 from the horizontal position in which it blocks opening of the door 4.

Figure 5:
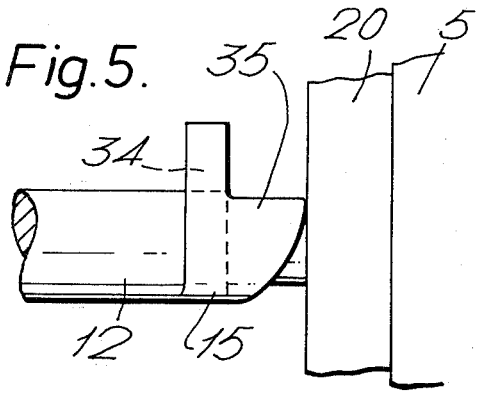
FIG. 5 illustrates in side elevation a detail of a cam mechanism associated with the customer's door.

The turning of the cam 15 that accompanies swinging of the bar 11 down into the horizontal position, also breaks abutment (illustrated in FIG. 5) between a bevelled projection 35 of the cam 15 and the block 20 on the rear of the door 5. Such abutment obstructs movement of the block 20 inwardly of the wall 6, necessary for the door 5 to open. Swinging of the bar 11 down into the horizontal, however, turns the cam 11 so as to clear the projection 35 from the path of the block 20 and enable the door 5 to be opened fully without obstruction.

If the customer's door 5 is not opened, or after having been opened is closed again with the handle 17 released, the bar 11 can be swung back to the vertical again to enable the cashier's door 4 to be opened. The cam 15 turns back with the return of the bar 11 to its vertical position, so as to obstruct effective operation of the handle 17 and opening of the door 5 until the bar 11 is once again returned to the horizontal. On the other hand, if the customer's door 5 after being opened, is left open, upward movement of the bar 11 from the bracket 13 towards the vertical will cause the door 5 to be closed; such movement also acts to overcome any attempt to hold the handle 17 operated with the bolts 22 and 23 withdrawn, during closing of the door 5.

Upward movement of the bar 11 from the bracket 13 turns the cam 15 to bring the projection 35 back into the path of the block 20. Thus if the customer's door 5 is open, such movement causes the projection 35 to strike the block 20, and as the bar 11 is raised further, to push the door 5 closed. The bevelling of the projection 35 ensures that the door 5 swings smoothly back to close as the bar 11 is swung upwardly, and to complete this before the vertical position of the bar 11 is reached, that is to say, in advance of the condition in which the cashier's door 4 becomes free to be opened. The force exerted on the door 5 by the upward movement of the bar 11 is adequate to achieve the positive latching of the bolts 22 and 23 with the wall 8, required to retain the door 5 firmly locked closed. It is to be noted in this respect that the spring force required for latching—established by the springs 25 and 27—can be different, and more particularly lighter, than the force established by the springs 26 and 30—required for unlatching through operation of the handle 17.

If any attempt is made to hold the handle 17 operated while the door 5 is closing under the action of upward movement of the bar 11, there will be immediate abutment of the rod 21 on a slope 36 of the cam 15. As the bar 11 continues to be swung upwardly to complete closing of the door 5, so the rod 21 will be forced back by the slope 36 of the turning cam 15, to overcome the operation of the handle 17.

Thus with the security transfer installation described, items can be transferred through the chamber 3 without the danger that the security of the wall 2 will be compromised. Not only is each door 4 and 5 positively precluded from being opened while the other is open, but action necessary as a preliminary to freeing the cashier's door 4 for opening—lifting of the bar 11—closes the customer's door 5 if it has been left open, and locks it closed whether it was open or not.

I claim:

1. In a security transfer arrangement in which access to a chamber for entering items into, and removing them from, the chamber, is made via two mutually-spaced doors, and in which provision is made to enable the doors to be opened to give access to the chamber, only one at a time, the improvement wherein said arrangement includes a member that is displaceable between a first position in which it obstructs opening of one of the doors and a second position in which it is clear from obstructing said one door so as to free that door for opening, and door-closing means responsive to displacement of said member from said first position towards said second position to close the other door if such is then open.

2. A security transfer arrangement according to claim 1 wherein said door-closing means comprises a mechanism responsive to displacement of said member from its said first position towards its said second position to exert force through abutment on said other door to close that door if such is then open.

3. A security transfer arrangement according to claim 1 wherein said other door has releasable-latch means for latching that door closed, and said door-closing means includes means for precluding release of the said latch means while said member is in its said second position.

4. A security transfer arrangement according to claim 3 wherein said means for precluding release of the latch means includes cam means coupled to said member to obstruct release of said latch means while said member is in its said second position.

5. A security transfer arrangement according to claim 4 wherein said cam means includes a face for abutting a part of said other door, and wherein displacement of said member towards its said second position urges said face against said part to swing said other door closed if such is then open.

6. A security transfer arrangement according to claim 2 wherein said mechanism includes cam means for abutting a part of said other door, and wherein displacement of said member towards its said second position urges said cam means against said part to swing said other door closed if such is then open.

7. A security transfer arrangement according to claim 6 wherein the cam means remains in abutment with said part to obstruct opening of said other door while said member is in its said second position.

8. A security transfer arrangement according to claim 1 wherein said one door is hinged to swing between open and closed conditions, and said member extends at least part way across said one door, so as to block opening of that door from its said closed condition, while said member is in its said first position.

9. A security transfer arrangement according to claim 8 wherein said member is a bar that extends fully across said one door when in its said first position, and said bar is mounted for pivotal displacement from across the door into its said second position.

10. A security transfer arrangement according to claim 1 including a hollow open-ended box structure, said two doors being mounted at opposite ends of said structure to close those two ends respectively.

11. In a security transfer arrangement in which access to a chamber for entering items into, and removing them from, the chamber, is made via two mutually-spaced doors, provision is made to enable the doors to be opened to give access to the chamber, only one at a time, said arrangement including a member at one of said doors mounted for pivotal displacement between a first position in which it obstructs outward opening movement of that door with respect to said chamber, and a second position in which it is clear of obstruction to said outward opening movement of said one door, and said pivotal displacement is substantially coplanar with said one door when that door is closed, the improvement wherein said member when in said first position extends at least part way across the outermost face of said one door in the path of said outward, opening movement thereof, to block any such movement, and said arrangement includes means responsive to displacement of said member into its said second position to block opening of the other of said doors.

12. A security transfer arrangement according to claim 11 including means intercoupled with said member to provide an abutting obstruction to opening of said other door while said member is in its said second position.

13. A security transfer arrangement according to claim 11 wherein said member is a pivotted bar.

14. In a security transfer arrangement in which access to a chamber for entering items into, and removing them from, the chamber, is made via two mutually-spaced doors, and in which provision is made to enable the doors to be opened to give access to the chamber, only one at a time, the improvement wherein said arrangement includes a member at one of said doors mounted for displacement between a first position in which it extends at least part way across said one door to obstruct opening of that door and a second position in which it is clear of obstruction to opening of said one door, and means responsive to displacement of said member into its said second position to block opening of the other of said doors, wherein said other door has a releasable-latch mechanism for latching that door closed, and wherein said arrangement further includes means for inhibiting release of the said latch mechanism while said member is in its said second position.

15. A security transfer arrangement according to claim 14 wherein said means for inhibiting release of the latch mechanism includes means coupled to said member to obstruct release of said latch mechanism while said member is in its said second position.

16. In a security transfer arrangement in which access to a chamber for entering items into, and removing them from, the chamber, is made via two mutually-spaced doors, and in which provision is made to enable the doors to be opened to give access to the chamber, only one at a time, the improvement wherein said arrangement includes a member at one of said doors mounted for pivotal displacement in an arc substantially coplanar with said one door when that door is closed, said displacement being between a first position in which said member extends fully across said one door to obstruct opening of that door and a second position in which it is clear of obstruction to opening of said one door, and means responsive to displacement of said member into its said second position to block opening of the other of said doors.

* * * * *